United States Patent [19]

Bellmann et al.

[11] 4,030,333

[45] June 21, 1977

[54] METHOD AND MEANS FOR SEPARATING SUCCESSIVE ROLLING LOTS

[75] Inventors: Manfred Bellmann, Breitscheid; Hannes Goldberg, Mulheim, both of Germany

[73] Assignee: Mannesmann Aktiengesellschaft, Dusseldorf, Germany

[22] Filed: Sept. 16, 1976

[21] Appl. No.: 723,695

[52] U.S. Cl. ..... 72/227; 72/483; 250/303

[51] Int. Cl.[2] ..... B21B 39/00

[58] Field of Search ..... 72/227, 199, 483; 148/12 R; 250/303

[56] References Cited

UNITED STATES PATENTS 3,790,398 2/1974 Dijkstra ..... 148/12 R

*Primary Examiner*—Milton S. Mehr

*Attorney, Agent, or Firm*—Cullen, Settle, Sloman & Cantor

[57] ABSTRACT

The method of gaplessly separating and identifying successive rolling lots of ingots or blooms in a production process for making tubes or the like wherein the stock is introduced into a furnace for heating and in a production line subsequently rolled, which comprises radio-actively marking the first or the last ingot of a given rolling lot of ingots at its subsequently lost end prior to being introduced into the furnace. A further step includes interposing a radio-active radiation responsive signal device in said production line before rolling. Apparatus for carrying out said method includes a device for imparting radioactivity to an ingot in advance of a rotary hearth furnace. Radiation counter-tubes are located in advance of a taper mill and a continuous rolling mill respectively. Further counter-tubes are arranged in advance of a stretch reducing or sizing mill. A non-radioactive marking device is arranged in registry with the rolled stock and operatively coupled with said further counter-tubes and located downstream of the sizing mill.

5 Claims, 1 Drawing Figure

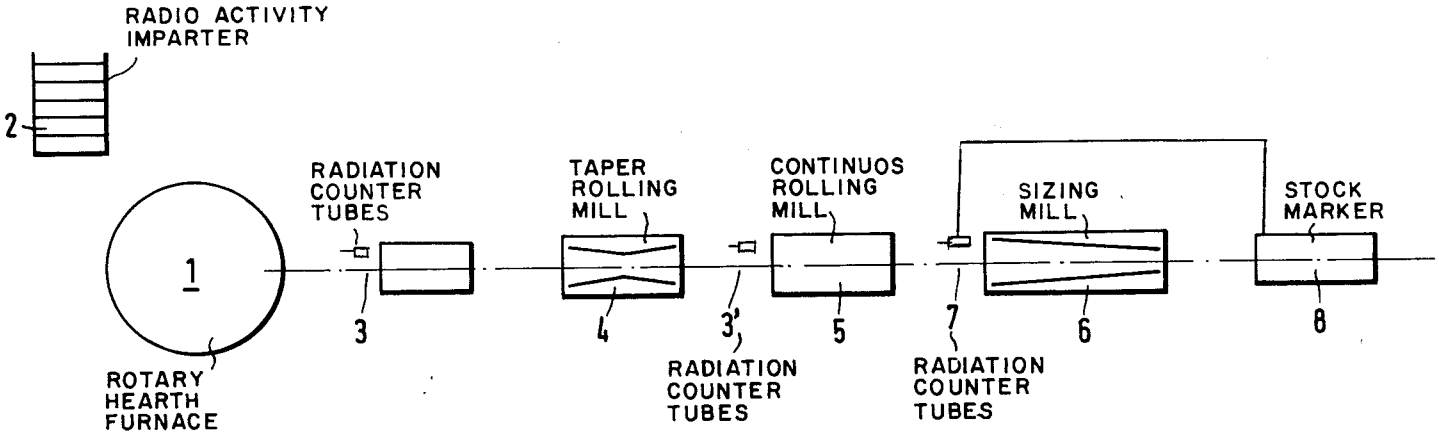
RADIO ACTIVITY IMPARTER
2
1
ROTARY HEARTH FURNACE
RADIATION COUNTER TUBES
3
TAPER ROLLING MILL
4
RADIATION COUNTER TUBES
3'
CONTINUOS ROLLING MILL
5
RADIATION COUNTER TUBES
7
SIZING MILL
6
STOCK MARKER
8

METHOD AND MEANS FOR SEPARATING SUCCESSIVE ROLLING LOTS

BACKGROUND OF THE INVENTION

This invention relates to a method for the gapless separation and identification of successive lots, or batches of rolled ingots or blooms in a production process for making tubes or the like, which invovles heating in a furnace and subsequent rolling of the stock.

In tube making, for example, by heating in a rotary hearth furnace, followed by rolling mills for rolling the heated bloom or ingot, the separation and identification of successive rolling "lots" or batches is currently obtained by leaving two spaces vacant in the rotary hearth furnace. Such breaks or gaps however involve a wasteful loss of rolling time and furnace capacity. Moreover, a clear separation of individual rolling lots, melts (heats) and materials, is somewhat difficult to achieve and there is a definite risk of mistakes and confusion.

SUMMARY OF THE INVENTION

It is the aim of this invention to provide a method and means for the gapless separation and identification of rolling "lots" or batches, which is capable of following the travel of one lot or batch of material from its introduction into the rotary hearth furnace to the cooling bed.

These and other objects will be seen from the following specification and claims in conjunction with the appended drawing.

THE DRAWING

The FIGURE in the drawing is a schematic illustration of the apparatus and the steps of the present process.

DETAILED DESCRIPTION OF THE INVENTION

With this aim in view, the invention proposes a method of gaplessly separating and identifying successive rolling lots, which is characterized in that the first, or the last, ingot of a lot or batch of ingots is radioactively marked at the end thereof (which is subsequently cut off as the "lost end",) before being introduced into the furnace and the radiation from this marking is signalled before rolling commences.

For preference the half-life period of the radioactive preparation used for marking purposes is at least two weeks, but should in no case exceed six weeks. Preferably a chrome-alloyed material is used for marking purposes.

There are several possible ways of marking the ingot:

a. Drilling a 3 mm hole and inserting a radioactive piece of wire.
b. Welding a mark onto the ingot by means of a radioactive electrode.
c. Welding an approximate 5 mm. diameter radioactive circular disc or label to the ingot.
d. Shooting a radioactive pin into the ingot surface.
e. Direct activation of integral parts of the ingot by radioation.

For the execution of the method according to this invention a device is proposed which consists of means 2 for imparting radioactivity to the ingot; radiation-counter tubes 3-3', 7 arranged forwardly of the taper-rolling mill 4 and of the continuous rolling mill 5 as well as behind the stretch-reducing or sizing mill 6; further means for characterizing the rolled stock and identifying it, which means are operatively coupled with counter-tubes at the sizing mill. A paint spray of conventional design presents itself particularly well as a marking device.

The last ingot of a given lot or batch is provided with a radioactive marking prior to being introduced into the rotary hearth furnace. This ingot is then located or identified in its passage through successive deformation stations with the aid of radiation counter-tubes. For example, the first ingot of the next lot may be released by the controlling operator only when the last ingot of the preceeding lot has issued a signal to the control desk via counter-tubes arranged behind the furnace.

The method according to this invention achieves a substantial economic advantage, particularly for small rolling lots or batches, by improved exploitation of available plant capacity. For example, it is possible to ensure the relative separation and identification of individual melts, types of material or rolling lots, with utmost accuracy and to follow it through the entire production process. The reported signals also allow perfect synchronization between the process calculator (programmer) and production process without any problem whatsoever.

One example of equipment suitable for execution of the method according to this invention is diagrammatically represented in the accompanying drawing.

A device 2 for imparting radioactivity is located forwardly of the rotary hearth furnace 1; radiation counter-tubes 3, 3' are arranged forwardly of the taper rolling mill 4 and of the continuous rolling mill 5. Another countertube 7 is positioned behind the sizing mill 6 and coupled with a device 8 for marking the stock, e.g., a paint spray.

Having described our invention, reference should now be had to the following Claims.

We claim:

1. The method of gaplessly separating and identifying successive rolling lots or batches of ingots or blooms in a production process for making tubes or the like when the stock is introduced into a furnace for heating and subsequently rolled, comprising radioactively marking the first or the last ingot of a given rolling lot of ingots at its subsequently lost end prior to being introduced into the furnace; and interposing a radioactive radiation responsive signal device before rolling.

2. The method according to claim 1, characterized in that the halflife period of the radioactive preparation used for marking purposes is at least two and at most six weeks.

3. The method according to claim 1, characterized in that a chrome-alloyed material is used for the radioactive preparation.

4. The method according to claim 1, characterized in that the radioactive marking is adapted for synchronizing a process calculator (programmer) with production progress.

5. Equipment for gaplessly separating and identifying successive rolling lots or batches of ingots or blooms in a production process for making tubes or the like wherein the stock is introduced into a rotary hearth furnace and successively through a taper rolling mill, a continuous rolling mill and a stretch-reducing or sizing mill; comprising a device for imparting radioactivity in advance of the rotary hearth furnace (1); radiation counter-tubes (3, 3') located in advance of the taper mill (4) and the continuous rolling mill (5) respectively; further counter-tubes (7) in advance of the stretch reducing mill (6); and nonradioactive marking or identification means in registry with the rolled stock operatively coupled with said further counter-tubes (7) and located downstream of said sizing mill.

* * * * *